US005664421A

United States Patent [19]

Matsue et al.

[11] Patent Number: 5,664,421

[45] Date of Patent: Sep. 9, 1997

[54] HEAT PUMP TYPE AIR CONDITIONER USING CIRCULATING FLUID BRANCHING PASSAGE

[75] Inventors: Junji Matsue, Kasagake-machi; Ryouichi Katouno, Oura-machi; Masahisa Ohtake, Oizumi-machi, all of Japan

[73] Assignee: Sanyo Electric Co., Ltd., Osaka, Japan

[21] Appl. No.: 628,123

[22] Filed: Apr. 4, 1996

[30] Foreign Application Priority Data

| | | | |
|---|---|---|---|
| Apr. 12, 1995 | [JP] | Japan | 7-086951 |
| Apr. 12, 1995 | [JP] | Japan | 7-086953 |
| Apr. 12, 1995 | [JP] | Japan | 7-086954 |

[51] Int. Cl.[6] ..... F25B 9/00

[52] U.S. Cl. ..... 62/6; 62/160

[58] Field of Search ..... 62/6, 160

[56] References Cited

U.S. PATENT DOCUMENTS

| | | | |
|---|---|---|---|
| 4,123,916 | 11/1978 | Kreger | 62/6 X |
| 4,312,188 | 1/1982 | Swenson et al. | 62/160 |
| 4,435,959 | 3/1984 | Mohr | 62/6 X |
| 4,514,979 | 5/1985 | Mohr | 62/6 X |
| 4,969,333 | 11/1990 | Osawa et al. | 62/6 |
| 4,996,841 | 3/1991 | Meijer et al. | 62/6 X |
| 5,400,599 | 3/1995 | Sekiya et al. | 62/6 |
| 5,465,580 | 11/1995 | Kwon | 62/6 |
| 5,522,222 | 6/1996 | Kwon | 62/6 |

FOREIGN PATENT DOCUMENTS 5-65777 9/1993 Japan .

*Primary Examiner*—Christopher Kilner
*Attorney, Agent, or Firm*—Darby & Darby

[57] ABSTRACT

A heat pump type air conditioner having a heat gas engine having a radiator and a cooler, an outdoor heat exchanger provided in an outdoor unit and an indoor heat exchanger provided in an indoor unit, is further provided with a heat exchanger in the outdoor unit and/or the indoor unit, and control means for controlling water flow in first and second passages so as to perform cooling/heating operation. When slightly-heating or slightly-cooling dry operation or defrosting operation is required, a part of the hot water from the radiator is allowed to selectively flow through the second fluid passage into the heat exchanger by adjusting opening degree of open/close valves disposed between the first and second fluid passages.

20 Claims, 6 Drawing Sheets

HEAT PUMP TYPE AIR CONDITIONER USING CIRCULATING FLUID BRANCHING PASSAGE

BACKGROUND OF THE INVENTION

1. Field of the Invention

The present invention relates to an improvement of a heat pump type air conditioner using a cooling source and a heat-radiating source of a heat gas engine such as an external combustion engine using a Stirling cycle or the like.

2. Description of Related Art

There has been hitherto known a separation type air conditioner having such a structure that an indoor heat exchanger and an outdoor heat exchanger of an air conditioner are linked to a cooling (endothermic) source and a heat-radiating source of a heat gas engine using a Stirling cycle (as disclosed in Japanese Post-examined Patent Application No. Hei-5-65777).

The stirling cycle is a regenerative heat cycle using a combination of change of four states, such as an isovolumeric (constant-volume) heating process, an isothermal (constant-temperature) expansion process, an isovolumeric cooling process and an isothermal compression process. The air conditioner using the Stirling cycle does not use any CFSs as refrigerant, and performs its air conditioning operation by using cold water and hot water which are cooled and heated through a cooling (heat absorption) process and a heat-radiation process, respectively. The cooling and heat-radiating processes are performed by pressure-increasing and pressure-reducing operations of helium gas which is completely harmless. Therefore, this type of air conditioners has been expected to be one of the next-generation which is harmless to the natural environment.

The separation type air conditioner as described above utilizes an external heating system of forcedly heating working gas with a high-temperature side heat exchanger to take out a low-temperature medium from a low-temperature side heat exchanger and an intermediate-temperature medium from an intermediate-temperature side heat exchanger and then use the low-temperature medium for cooling and the intermediate medium for heating. Specifically, in room-cooling operation, a close cycle connecting the low-temperature side heat exchanger and the indoor heat exchanger, and a close cycle connecting the intermediate-temperature side heat exchanger and the outdoor heat exchanger are respectively formed by switching change-over valves. Therefore, the heat of the low-temperature medium is radiated into a room (i.e., the heat of the room is absorbed to the low-temperature medium) by the indoor heat exchanger to cool the room, and the heat of the intermediate medium is discharged to the outside by the outdoor heat exchanger. On the other hand, in room-heating operation, a close cycle connecting the intermediate-temperature side heat exchanger and the indoor heat exchanger is formed by switching the change-over valves. Therefore, the heat of the intermediate medium is discharged into the room by the indoor heat exchanger to heat the room, and the heat of the low-temperature medium is discharged to the outside (i.e., the heat of the outside is absorbed to the low-temperature medium) by the outdoor heat exchanger.

As described above, the above-mentioned conventional air conditioner is equipped with only one outdoor heat exchanger and only one indoor heat exchanger. Accordingly, when the outdoor heat exchanger is frosted during the room-heating operation in the air conditioner thus constructed, only the following defrosting manner can be effectively used. That is, in the room-heating operation, the hot water (cold water) which is obtained through heat exchange operation based on heat-radiation action (cooling (heat absorption) action) in the Stirling cycle, flows into the indoor heat exchanger (the outdoor heat exchanger) during room-heating operation, whereby the room is heated. At this time, when the outdoor heat exchanger is frosted, the room-heating operation is temporarily stopped, and then the hot water which has been used to heat the room is made to flow into the frosted outdoor heat exchanger, thereby defrosting the frosted outdoor heat exchanger. However, the temporary cease operation of the room-heating operation reduces driving efficiency of the air conditioner. Further, in a middle season such as a rainy or wet season, the indoor heat exchanger is sometimes required to perform dry operation. In order to perform the dry operation, the cold water is made to flow in the indoor heat exchanger while the hot water is made to flow in the outdoor heat exchanger. At this time, the room is dried by the cold water, but at the same time it is cooled by the cold water. Accordingly, it is difficult to perform slightly heating or slightly cooling dry operation.

SUMMARY OF THE INVENTION

The above problem is caused by such a situation that only one of the hot water and the cold water is supplied to each of the indoor heat exchanger and the outdoor heat exchanger, and a means of solving the above problem has been required.

The present invention has been achieved in view of the foregoing problem of the conventional air conditioner, and a first object of the present invention is to provide a heat pump type air conditioner which can easily perform defrosting operation in room-heating operation without temporarily ceasing the room-heating operation.

A second object of the present invention is to provide a heat pump type air conditioner which can easily perform slightly-heating or slightly-cooling dry operation.

A third object of the present invention is to provide a heat pump type air conditioner which can easily control slightly-heating or slightly-cooling dry operation, defrosting operation under the room-heating operation, etc.

In order to attain the above objects, the heat pump type air conditioner according to the present invention includes a heat gas engine having a cooler and a radiator, a first outdoor heat exchanger provided in an outdoor unit, a first indoor heat exchanger provided in an indoor unit, at least one heat exchanger provided in the outdoor unit and/or the indoor unit, a first fluid passage through which fluid cooled through heat-exchange operation of the cooler is guided to one of the first indoor heat exchanger and the first outdoor heat exchanger, and fluid heated through heat-exchange operation of the radiator is guided to the other of the first indoor heat exchanger and the first outdoor heat exchanger in cooling or room-heating operation, a second fluid passage through which a part of the fluid heated by the radiator is guided to the at least one heat exchanger, and fluid branching means for selectively allowing the part of the fluid heated by the radiator to flow into the second fluid passage.

In the heat pump type air conditioner as described above, the fluid branching means may comprise flow amount adjusting means for adjusting the flow amount of the branched part of the heated fluid into the second fluid passage.

In the heat pump type air conditioner as described above, the flow amount adjusting means may comprise opening/closing valves which are adjustable in opening degree to adjust the flow amount of the branched part of the heated fluid.

In the heat pump type air conditioner as described above, the heat gas engine may comprise an external combustion engine using a Stirling cycle.

In the heat pump type air conditioner as described above, the fluid may comprise water.

In the heat pump type air conditioner as described above, the heat exchanger may comprise a second outdoor heat exchanger which is provided in the outdoor unit and into which the branched heated fluid flows from the second fluid passage, and the heat pump type air conditioner may be further provided with control means for controlling the first fluid passage so that the heated fluid from the radiator flows into the first indoor heat exchanger and the cold water from the cooler flows into the first outdoor heat exchanger in the room-heating operation, and controlling the fluid branching means so that the branched part of the heated fluid from the radiator flows into the second outdoor heat exchanger when the first outdoor heat exchanger is defrosted.

In the heat pump type air conditioner as described above, the first fluid passage and the second fluid passage may be juxtaposed with each other.

In the heat pump type air conditioner as described above, the first outdoor heat exchanger and the second outdoor heat exchanger may be formed separately with each other or integrally with each other.

In the heat pump type air conditioner as described above, the second outdoor heat exchanger is disposed at an upstream side of the first outdoor heat exchanger, whereby the first outdoor heat exchanger is defrosted by the heat of the heated fluid in the second outdoor heat exchanger.

In the heat pump type air conditioner as described above, the heat exchanger may comprise a second indoor heat exchanger which is provided in the indoor unit and into which the branched heated fluid flows from the second fluid passage, and the heat pump type air conditioner may be further provided with control means for controlling the first fluid passage so that the cooled fluid from the cooler flows into the first indoor heat exchanger and controlling the fluid branching means so that the branched part of the heated fluid from the radiator flows into the second indoor heat exchanger when dry operation is carried out.

In the heat pump type air conditioner as described above, the first fluid passage and the second fluid passage may be juxtaposed with each other.

In the heat pump type air conditioner as described above, the first indoor heat exchanger and the second indoor heat exchanger may be formed separately with each other or integrally with each other.

In the heat pump type air conditioner as described above, the second indoor heat exchanger is disposed at a downstream side of the first indoor heat exchanger, whereby air which is cooled by the first indoor heat exchanger is heated by the heat of the heated fluid in the second indoor heat exchanger to perform slightly-heating or slightly-cooling dry operation.

In the heat pump type air conditioner as described above, the heat exchanger may comprise a second outdoor heat exchanger and a second indoor heat exchanger which are provided in the outdoor unit and the indoor unit respectively and into which the branched heated fluid flows from the second fluid passage, and the heat pump type air conditioner may be further provided with control means for controlling the first fluid passage so that the heated fluid from the radiator flows into the first indoor heat exchanger and the cold water from the cooler flows into the first outdoor heat exchanger in the room-heating operation, and controlling the fluid branching means so that the branched part of the heated fluid from the radiator flows into the second outdoor heat exchanger when the first outdoor heat exchanger is defrosted in the room-heating operation, and for controlling the first fluid passage so that the cooled fluid from the cooler flows into the first indoor heat exchanger and controlling the fluid branching means so that the branched part of the heated fluid from the radiator flows into the second indoor heat exchanger when dry operation is performed.

In the heat pump type air conditioner as described above, the fluid branching means may comprise flow amount adjusting means for adjusting the flow amount of the branched part of the heated fluid into the second fluid passage.

In the heat pump type air conditioner as described above, the flow amount adjusting means may comprise a first open/close valve which is disposed between the first and second fluid passages and is adjustable in opening degree so that the part of the heated fluid from the radiator flows into the second indoor heat exchanger when a dry operation is performed, and a second open/close valve which is disposed between the first and second fluid passages and is adjustable in opening degree so that the part of the heated fluid from the radiator flows into the second outdoor heat exchanger when a defrosting operation is performed in room-heating operation.

In the heat pump type air conditioner as described above, the first indoor-heat exchanger and the second indoor heat exchanger are formed separately from each other or integrally with each other, and/or the first outdoor heat exchanger and the second outdoor heat exchanger are formed separately from each other or integrally with each other.

In the heat pump type air conditioner as described above, the first fluid passage and the second fluid passage are juxtaposed with each other.

According to the heat pump type air conditioner as described above, when a normal cooling or room-heating operation is performed, the heated fluid from the radiator flows through the first fluid passage into the first outdoor heat exchanger (or first indoor heat exchanger) while the cooled fluid from the cooler flows through the first fluid passage into the first indoor heat exchanger (or first outdoor heat exchanger). At this time, when the outdoor heat exchanger is required to be defrosted, the heated fluid from the radiator is branched by the fluid branching means, and a branched part of the heated fluid flows through the second fluid passage into the second outdoor heat exchanger. Therefore, even when the first outdoor heat exchanger is frosted in the room-heating operation, the frosted first outdoor heat exchanger is defrosted by the heat of the heated fluid in the second outdoor heat exchanger. Accordingly, the defrosting operation can be easily performed. Further, if a part of the heated fluid is allowed to flow into the second outdoor heat exchanger through the second fluid passage in the room-cooling operation, not only the first outdoor heat exchanger, but also the second outdoor heat exchanger can serve to radiate heat to the outside, so that a heat transfer area for heat radiation is increased, and thus a radiation characteristic can be improved. On the other hand, when the dry operation is performed, the heated fluid from the radiator is branched by the fluid branching means so that a branched part of the heated fluid flows through the second fluid passage into the second indoor heat exchanger. Therefore, air which is cooled and dried by the first indoor heat exchanger is heated by the second indoor heat exchanger to thereby easily perform slightly-heating or slightly-cooling dry operation.

Further, according to the heat pump type air conditioner of the present invention, the open/close valves which are adjustable in opening degree is used as means of allowing a part of the heated fluid from the radiator to selectively flow into the second fluid passage, so that the drying operation and the defrosting operation can be easily performed with variable power.

Still further, according to the heat pump type air conditioner of the present invention, the first fluid passage and the second fluid passage are juxtaposed with each other, so that a pipe arrangement can be easily performed.

In the heat pump type air conditioner as described above, the first indoor heat exchanger and the second indoor heat exchanger (the first outdoor heat exchanger and the second outdoor heat exchanger) may be formed separately from each other or integrally with each other, and the same effect can be obtained in both cases.

DETAILED DESCRIPTION OF THE PREFERRED EMBODIMENTS

Preferred embodiments according to the present invention will be described hereunder with reference to the accompanying drawings.

Figure 1:
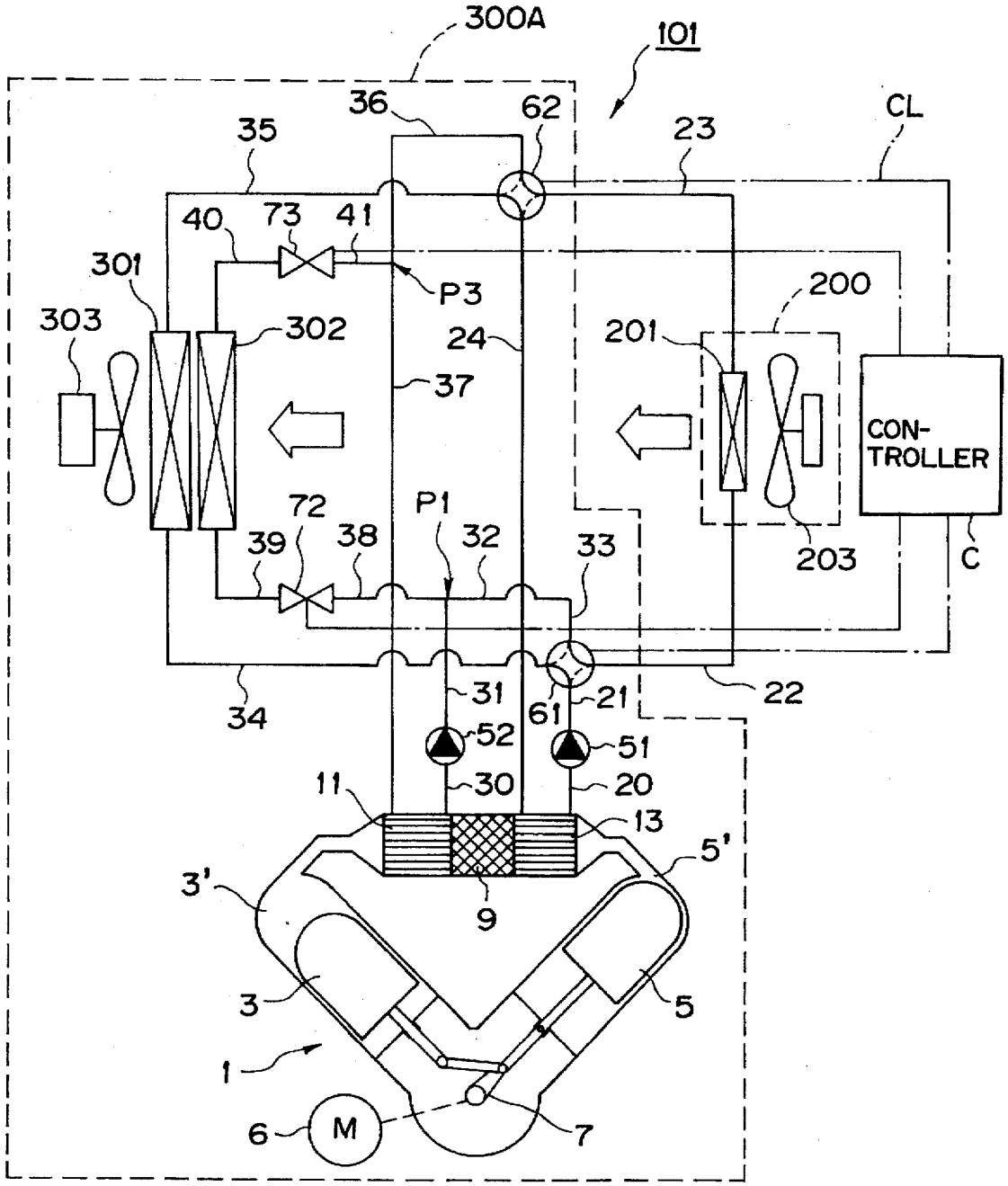
FIG. 1 is a circuit diagram showing a first embodiment of a heat pump type air conditioner according to the present invention.

FIG. 1 shows a cooled and heated fluid supply circuit for an air conditioner which is a first embodiment of the heat pump type air conditioner of the present invention. In this circuit, a heat gas engine 1 using a Stirling cycle is used as a heat source. The following embodiments use water as fluid which is heat-exchanged with air in outdoor heat exchanger and indoor heat exchanger while circulating in the circuit. However, the fluid of the present invention is not limited to water, and any material may be used insofar as it serves as a carry medium which can be heat-exchanged by the heat gas engine.

As shown in FIG. 1, the heat gas engine 1 using the Stirling cycle mainly includes a high-temperature side piston 3, a high-temperature side cylinder 3', a low-temperature side piston 5, a low-temperature side cylinder 5', a regenerator 9, an intermediate-temperature heat exchanger 11, and a low-temperature heat exchanger 13. This construction is disclosed in U.S. Pat. No. 4,969,333, for example, and the detailed description thereof is omitted.

The pistons 3 and 5 are linked to each other through a crank 7 driven by a motor 6 so as to be relatively movable with a phase difference of 90°, for example, so that the low-temperature side piston 5 reaches the top dead point when the high-temperature side piston 3 moved upwardly and reaches the middle point. Upon actuation of the high-temperature side piston 3 and the low-temperature side piston 5, helium filled in the cylinders 3' and 5' is passed through the regenerator 9 by the displacement of the pistons 3 and 5. The helium is passed through the regenerator 9 while heated or cooled, or varied in its volume by the pistons, whereby the pressure of the helium is increased or reduced. When the pressure of the sealed helium is increased, the temperature of the helium rises up to radiate its heat to the intermediate-temperature heat exchanger 11. On the other hand, when the pressure of the helium is reduced, the temperature thereof falls down to absorb heat from the low-temperature heat exchanger 13 (i.e.,cool the low-temperature heat exchanger 13). That is, the low-temperature heat exchanger 13 serves as a cooler of the heat gas engine 1 while the intermediate-temperature heat exchanger 11 serves as the radiator of the heat gas engine 1.

According to the first embodiment, an air conditioner 101 using a low-temperature heat exchanger (cooler) 13 and a intermediate-temperature heat exchanger (radiator) 11 of the heat gas engine 1 as described above is provided as shown in FIG. 1. The air conditioner 101 includes an indoor unit 200 and an outdoor unit 300A, and the outdoor unit 300A contains the heat gas engine 1.

An indoor heat exchanger 201 is disposed in the indoor unit 200, and a first outdoor heat exchanger 301 and a second outdoor heat exchanger 302 which are respectively connected to two pipe systems are juxtaposed in the outdoor unit 300A as shown in FIG. 1. Reference numeral 203 represents an indoor fan, and reference numeral 303 represents an outdoor fan.

The low-temperature heat exchanger (cooler) 13 and the indoor heat exchanger 201 are connected to each other through a Water pipe 20, a cold water circulating pump 51, a water pipe 21, a four-way valve 61 and a water pipe 22 in this order. In addition, the indoor heat exchanger 201 and the low-temperature heat exchanger (cooler) 13 are connected to each other through a water pipe 23, a four-way valve 62 and a water pipe 22 in this order.

Further, the intermediate-temperature heat exchanger (radiator) 11 and the first outdoor heat exchanger 301 are connected to each other through a water pipe 30, a hot water circulating pump 52, water pipes 31, 32 and 33, a four-way valve 61 and a water pipe 34, and also connected to each other through a water pipe 35, a four-way valve 62 and water pipes 36 and 37. The water pipe 31 is branched (bifurcated) into the water pipe 32 and a water pipe 38 at a position P1, and the water pipes 36 and 41 are joined into the water pipe 37 at a position P3.

An open/close valve 72 is connected to a water pipe 38 at one port thereof, and also connected to a water pipe 39 at the other port thereof. The water pipe 39 is also connected to the second outdoor heat exchanger 302. The second outdoor heat exchanger 302 is connected to a water pipe 40. The water pipe 40 is also connected to an open/close valve 73, and the open/close valve 73 is also connected to the water pipe 41. Each of the open/close valves 72 and 73 is designed to be adjustable in its opening degree, and the flow amount of fluid (water) passing through each valve can be adjusted by controlling the opening degree of the valve. Each of the four-way valves 61 and 62 and the open/close valves 72 and 73 is equipped with an actuator (not shown) for driving each valve, and these actuators are connected to a controller C such as a microcomputer or the like, and controlled in accordance with each driving mode by the controller C through control lines CL (as indicated by one-dotted chain lines).

Next, a normal room-cooling/room-heating operation (cycle) of the air condition of the first embodiment will be described with reference to FIG. 1.

In a normal room-heating operation, the four-way valves 61 and 62 are switched as indicated by solid lines shown in FIG. 1, and the open/close valves 72 and 73 are closed through a control operation of the controller C. In this case, hot water which is heated by the intermediate-temperature heat exchanger (radiator) 11 flows from the intermediate-temperature heat exchanger (radiator) 11 through the water pipe 30, the hot water circulating pump 52, the water pipes 31, 32 and 33, the four-way valve 61 and the water pipe 22 into the indoor heat exchanger 201. The hot water in the indoor heat exchanger 201 is heat-exchanged with air in a room while the indoor fan 203 is rotated, and warm air is blown off into the room. After the heat exchange, the water passes from the indoor heat exchanger 201 through the water pipe 23, the four-way valve 62 and the water pipes 36 and 37 and returns to the intermediate-temperature heat exchanger (radiator) 11. Through this cycle, the room-heating operation of the room is performed.

At this time, cold water which is cooled (heat-absorbed) by the low-temperature heat exchanger (cooler) 13 flows through the water pipe 20, the cold water circulating pump 51, the water pipe 21, the four-way valve 61 and the water pipe 34 into the first outdoor heat exchanger 301. The cold water in the first indoor heat exchanger 301 is heat-exchanged with the outside air while the outdoor fan 303 is rotated, and then passes through the water pipe 35, the four-way valve 62 and the water pipe 24 and returns into the low-temperature heat exchanger (cooler) 13.

Next, in a normal room-cooling operation, the four-way valves 61 and 62 are switched as indicated by dotted lines of FIG. 1, and the open/close valves 72 and 73 are closed by the controller C. In this case, the cold water which is cooled by the low-temperature heat exchanger (cooler) 13 flows through the water pipe 20, the cold water circulating pump 51, the water pipe 21, the four-way valve 61 and the water pipe 22 into the indoor heat exchanger 201. The cold water in the indoor heat exchanger is heat-exchanged with room air while the indoor fan 203 is rotated to blow out the cold water into the room. After the heat exchange, the water passes through the water pipe 23, the four-way valve 62 and the water pipe 24 and returns into the low-temperature heat exchanger (cooler) 13.

At this time, the hot water which is heated by the intermediate-temperature heat exchanger (radiator) 11 flows through the water pipe 30, the hot water circulating pump 52, the water pipes 31, 32 and 33, the four-way valve 61 and the water pipe 34 into the first outdoor heat exchanger 301. The hot water in the first outdoor heat exchanger 301 is heat-exchanged with the outside air while the outdoor fan 303 is rotated to blow out the hot air into the outside. After the heat exchange, the water passes through the water pipe 35, the four-way valve 62 and the water pipes 36 and 37 and returns into the intermediate-temperature heat exchanger (radiator) 11.

In the above room-cooling operation, if the open/close valve 72, 73 is opened, the hot water which is heated by the intermediate-temperature heat exchanger (radiator) 11 and then passed through the water pipe 30, the hot water circulating pump 52 and the water pipe 31, is bifurcated into the water pipe 32 and the water pipe 38 at the position P1. One branched hot water flows through the water pipes 32 and 33 into the indoor heat exchanger 201 or the first outdoor heat exchanger 301 in the same manner as described above. The other branched hot water flows through the water pipe 38, the open/close valve 72 and the water pipe 39 into the second outdoor heat exchanger 302. The hot water in the second outdoor heat exchanger 302 is heat-exchanged with the outside air while the outdoor fan 303 is rotated. After the heat exchange, the water in the outdoor heat exchanger 302 flows through the water pipes 40 and 41 and returns into the intermediate-temperature heat exchanger (radiator) 11.

In the above case, the first outdoor heat exchanger 301 and the second outdoor heat exchanger 302 are used in combination to radiate the heat of the hot water to the outside in the room-cooling operation. Therefore, the transfer area for radiation increases and thus the heat radiation characteristic is expected to be improved. It is generally known in a heat pump that heating value of heat-radiation is larger than that of heat-absorption. That is, an exchange heating value of the outdoor heat exchanger in the room-cooling operation is larger than that in the room-heating operation, and thus a severer heat-transfer characteristic is required for the outdoor heat exchanger in the room-cooling operation than in the room-heating operation. According to this embodiment, the heat exchange capacity (area) in the room-cooling operation can be set to a large value because the second outdoor heat exchanger is also used as a heat radiator to the outside in-the room-cooling operation. Therefore, this embodiment meets the requirement for the heat pump.

Further, according to this embodiment, the outdoor heat exchanger is sectioned into two systems, one of which is a system of the first outdoor heat exchanger side and the other of which is a system of the second outdoor heat exchanger side as described above. Therefore, a heating and defrosting operation as described later can be performed in this embodiment.

The heating and defrosting operation is defined as such an operation as to defrost the first outdoor heat exchanger 301 when the first outdoor heat exchanger 301 is frosted due to flow of the cold water therethrough in the room-heating operation. In this case, the four-way valves 61 and 62 are switched as indicated by the solid lines of FIG. 1 and the open/close valves 72 and 73 are fully opened by the controller C. Under this control, simultaneously with the water cycle of the normal heating operation, the hot water heated by the intermediate-temperature heat exchanger (radiator) 11 flows through the water pipe 30, the hot water circulating pump 52 and the water pipe 31, and are partially branched into the water pipe 38 at the position P1. The partially branched hot water passes through the fully-opened open/close valve 72 and the water pipe 39 into the second outdoor heat exchanger 302. The hot water in the second outdoor heat exchanger 302 is heat-exchanged with the outside air to be supplied to the first heat exchanger 301 while the outdoor fan 303 is rotated. After the heat exchange, the water in the second outdoor heat exchanger 302 flows through the water pipe 40, the fully-opened open/closed valve 73 and the water pipe 41 and joins with the water in the water pipe 37, and then returns into the intermediate-temperature heat exchanger (radiator) 11.

Through the above cycle, the hot water flows into the second outdoor heat exchanger 302, and the air to be supplied to the first outdoor heat exchanger 301 is heated by the second outdoor heat exchanger 302. Therefore, even when the first outdoor heat exchanger 301 is frosted, the frosted first outdoor heat exchanger 301 can be defrosted by the heat of the heated air without temporarily stopping the room-heating operation (i.e., while continuing the room-heating operation).

In this embodiment, the open/close valves 72 and 73 may be controlled not to be fully opened, but to be partially opened (i.e., to have a proper opening degree). For example, the flow amount of the refrigerant (water) flowing in the second outdoor heat exchanger 302 may be varied by adjusting the opening degree of one open/close valve 72. The flow amount of the refrigerant flowing in the second outdoor heat exchanger 302 can be sequentially reduced as the opening degree of the open/close valve is reduced, so that the defrosting power can be suppressed to the indispensable and minimum value. This is because use of the hot water for defrosting causes reduction in efficiency (power) of the air conditioner.

The same effect can be obtained when only one of the open/close valves 72 and 73 is used. In this case, an opening-degree adjusting mechanism is preferably provided to the open/close valve. The difference in effect between when the two open/close valves are used and when only one open/close valve is used is remarkably small, and there is no substantially difference in function.

Figure 2:
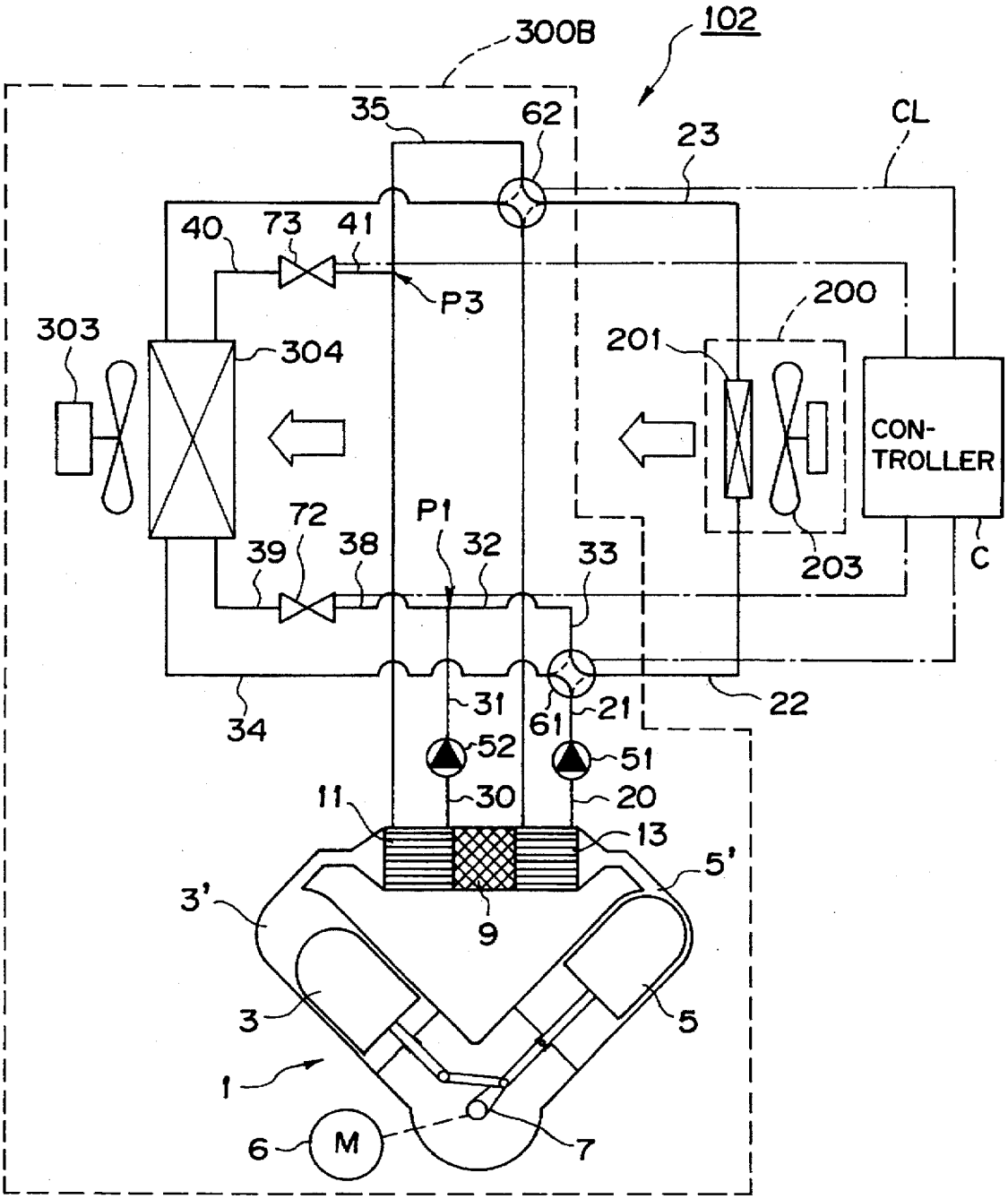
FIG. 2 is a circuit diagram showing a modification of the first embodiment shown in FIG. 1.

FIG. 2 shows a modification of the first embodiment.

The modification of FIG. 2 has substantially the same construction as the first embodiment except that the first and second outdoor heat exchangers 301 and 302 are integrally formed as a single outdoor heat exchanger 304 connected two pipe systems. The same elements as the first embodiment are represented by the same reference numerals, and the description thereof is omitted.

In the above embodiments, a route which connects the low-temperature heat exchanger (cooler) 13 or the intermediate-temperature heat exchanger (radiator) 11 and the indoor heat exchanger 201 or the first outdoor heat exchanger 301 in the normal cooling or heating operation corresponds to a first fluid passage, and a route which connects the intermediate-temperature heat exchanger (radiator) 11 and the second outdoor heat exchanger 302 in the heating and defrosting operation corresponds to a second fluid passage. As shown in FIGS. 1 and 2, the first fluid passage and the second fluid passage may be juxtaposed with each other. In this case, the pipe arrangement of the first and second fluid passages, etc. can be facilitated. Further, if the first outdoor heat exchange and the second outdoor heat exchange are juxtaposed with each other, the effect of the second outdoor heat exchanger can be more enhanced.

Figure 3:
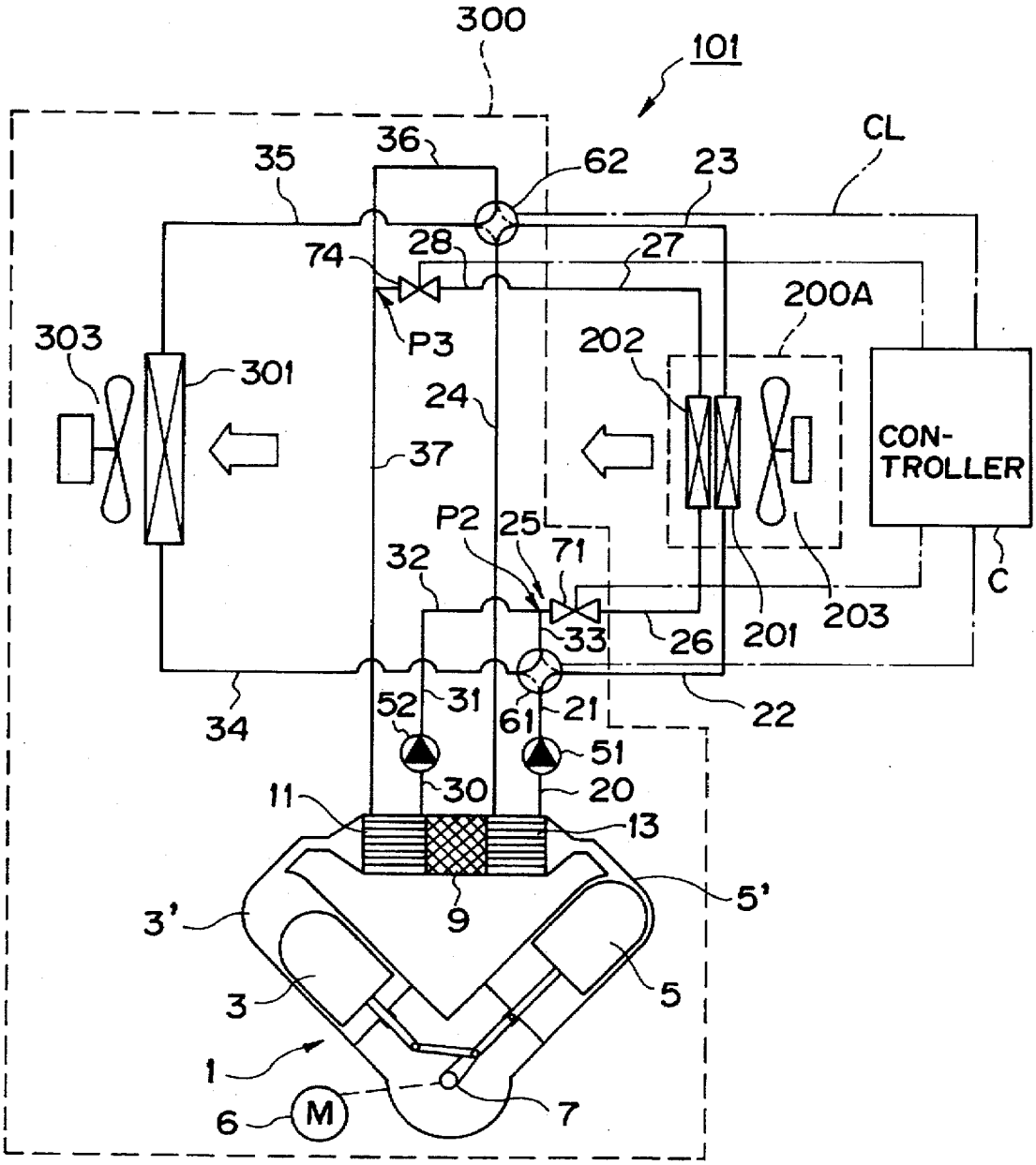
FIG. 3 is a circuit diagram showing a second embodiment of the heat pump type air conditioner according to the present invention.

FIG. 3 shows a cold/hot fluid supply circuit according to a second embodiment of the heat pump type air conditioner of the present invention.

This embodiment has substantially the same construction as the first embodiment shown in FIG. 1, except that the air conditioner is provided with an outdoor heat exchanger and two indoor heat exchangers (first and second indoor heat exchangers), and the second fluid passage is connected to the indoor heat exchanger side so that the hot water heated by the radiator 11 partially flows into the second indoor heat exchanger. The same elements as the first embodiment are represented by the same reference numerals, and the detailed description thereof is omitted.

In this embodiment, the first indoor heat exchanger 201 and the second indoor heat exchanger 202 which are sectioned so as to be connected to two pipe systems respectively are juxtaposed with each other in the indoor unit 200A, and an outdoor heat exchanger 301 is disposed in the outdoor unit 300.

The low-temperature heat exchanger (cooler) 13 and the first indoor heat exchanger 201 are connected to each other through the water pipe 20, the cold water circulating pump 51, the water pipe 21, the four-way valve 61 and the water pipe 22 in this order, and further the first indoor heat exchanger 201 and the low-temperature heat exchanger (cooler) 13 are connected to each other through the water pipe 23, the four-way valve 62 and the water pipe 24 in this order.

The intermediate-temperature heat exchanger (radiator) 11 and the outdoor heat exchanger 301 are connected to each other through the water pipe 30, the hot water circulating pump 52, the water pipes 31, 32 and 33, the four-way valve 61 and the water pipe 34 in this order, and further the outdoor heat exchanger 301 and the intermediate-temperature heat exchanger (radiator) 11 are connected to each other through the water pipe 35, the four-way valve 62 and the water pipes 36 and 37 in this order. The water pipe 32 is bifurcated into the water pipe 33 and the water pipe 25 at a position P2, and the water pipe 36 and the water pipe 28 are joined into the water pipe 37 at the position P3.

The water pipe 25 is connected to a first open/close valve 71, and the first open/close valve 71 is also connected to a water pipe 26, and the water pipe 26 is also connected to the second indoor heat exchanger 202. The second indoor heat exchanger 202 is also connected to a water pipe 27, and the water pipe 27 is also connected to an open/close valve 74. The open/close valve 74 is also connected to a water pipe 28.

Next, a normal room-cooling/room-heating operation of the air conditioner of this embodiment will be described with reference to FIG. 3.

In a normal room-cooling operation, the four-way valves 61 and 62 are switched as indicated by solid lines shown in FIG. 3, and the open/close valves 71 and 74 are closed through a control operation of the controller C. In this case, the cold water which is cooled by the low-temperature heat exchanger (cooler) 13 flows through the water pipe 20, the cold water circulating pump 51, the water pipe 21, the four-way valve 61 and the water pipe 22 into the first indoor heat exchanger 201. The cold water in the first indoor heat exchanger is heat-exchanged with room air while the indoor fan 203 is rotated to blow out the cold water into the room. After the heat exchange, the water passes through the water pipe 23, the four-way valve 62 and the water pipe 24 and returns into the low-temperature heat exchanger (cooler) 13.

At this time, the hot water which is heated by the intermediate-temperature heat exchanger (radiator) 11 flows through the water pipe 30, the hot water circulating pump 52, the water pipes 31, 32 and 33, the four-way valve 61 and the water pipe 34 into the outdoor heat exchanger 301. The hot water in the outdoor heat exchanger 301 is heat-exchanged with the outside air while the outdoor fan 303 is rotated to blow out the hot air to the outside. After the heat exchange, the water passes through the water pipe 35, the four-way valve 62 and the water pipes 36 and 37 and returns into the intermediate-temperature heat exchanger (radiator) 11.

In a normal roam-heating operation, the four-way valves 61 and 62 are switched as indicated by dotted lines of FIG. 3 and the open/close valves 71 and 74 are closed by the controller C. In this case, hot water which is heated by the intermediate-temperature heat exchanger (radiator) 11 flows from the intermediate-temperature heat exchanger (radiator) 11 through the water pipe 30, the hot water circulating pump 52, the water pipes 31, 32 and 33, the four-way valve 61 and the water pipe 22 into the first indoor heat exchanger 201.

The hot water in the indoor heat exchanger 201 is heat-exchanged with the room air while the indoor fan 203 is rotated, and warm air is blown off into the room. After the heat exchange, the water passes from the first indoor heat exchanger 201 through the water pipe 23, the four-way valve 62 and the water pipes 36 and 37 and returns to the intermediate-temperature heat exchanger (radiator) 11. Through this cycle, the room-heating operation of the room is performed.

At this time, cold water which is cooled (heat-absorbed) by the low-temperature heat exchanger (cooler) 13 flows through the water pipe 20, the cold water circulating pump 51, the water pipe 21, the four-way valve 61 and the water pipe 34 into first outdoor heat exchanger 301. The cold water in the indoor heat exchanger 301 is heat-exchanged with the outside air while the outdoor fan 303 is rotated, and then passes through the water pipe 35, the four-way valve 62 and the water pipe 24 and returns into the low-temperature heat exchanger (cooler) 13.

According to this embodiment, the indoor heat exchanger is sectioned into two systems, one of which is a system of the first indoor heat exchanger side and the other of which is a system of the second indoor heat exchanger side as described above. Therefore, a slightly-heating or slightly-cooling dry operation as described later can be also performed in this embodiment.

The slightly-heating or slightly-cooling dry operation is suitable for a middle season such as a rainy or wet season or the like in which an user does not feel so hot, but feels uncomfortable due to high moisture, and thus he needs somewhat hot or cold dry atmosphere (he feels too cold with only the dry operation).

In this case, the four-way valves 61 and 62 are switched as indicated by the solid lines of FIG. 3 and the open/close valves 71 and 74 are fully opened by the controller C. Under this control, simultaneously with the water circulating cycle of the normal cooling operation, the hot water heated by the intermediate-temperature heat exchanger (radiator) 11 flows through the water pipe 30, the hot water circulating pump 52 and the water pipes 31 and 32, and then are partially branched into the water pipe 25 at the position P2. The partially branched hot water passes through the fully-opened open/close valve 71 and the water pipe 26 into the second indoor heat exchanger 202. The hot water in the second indoor heat exchanger 202 is heat-exchanged with the cold air supplied from the first indoor heat exchanger 201 while the indoor fan 203 is rotated. The air is slightly heated without varying its humidity, and then blown out into the room. After the heat exchange, the water in the second indoor heat exchanger 202 flows through the water pipe 27, the fully-opened open/closed valve 74 and the water pipe 28 and loins with the water in the water pipe 37 at the join position P3, and then returns into the intermediate-temperature heat exchanger (radiator) 11.

Through the above cycle, the air which has been cooled by the first indoor heat exchanger 201 is slightly heated by the second indoor heat exchanger 202, and then blown out into the room, thereby performing the slightly-heating dry operation.

In this embodiment, the open/close valves 71 and 74 may be controlled not to be fully opened, but to be partially opened (i.e., to have a proper opening degree). For example, the flow amount of the refrigerant (water) flowing in the second indoor heat exchanger 202 may be varied by adjusting the opening degree of one open/close valve 71. In this case, the temperature of the air after heated can be finely controlled by adjusting the flow amount of the hot water.

Any one of the slightly-heating dry or slightly-cooling dry can be achieved by adjusting the opening degree of at least one of the open/close valves 71 and 74. Further, the same effect can be obtained when only one of the open/close valves 71 and 74 is used. In this case, a opening-degree adjusting mechanism is preferably provided to the open/close valve. The difference in effect between when the two open/close valves are used and when only one open/close valve is used is remarkably small, and there is no substantially difference in function.

Figure 4:
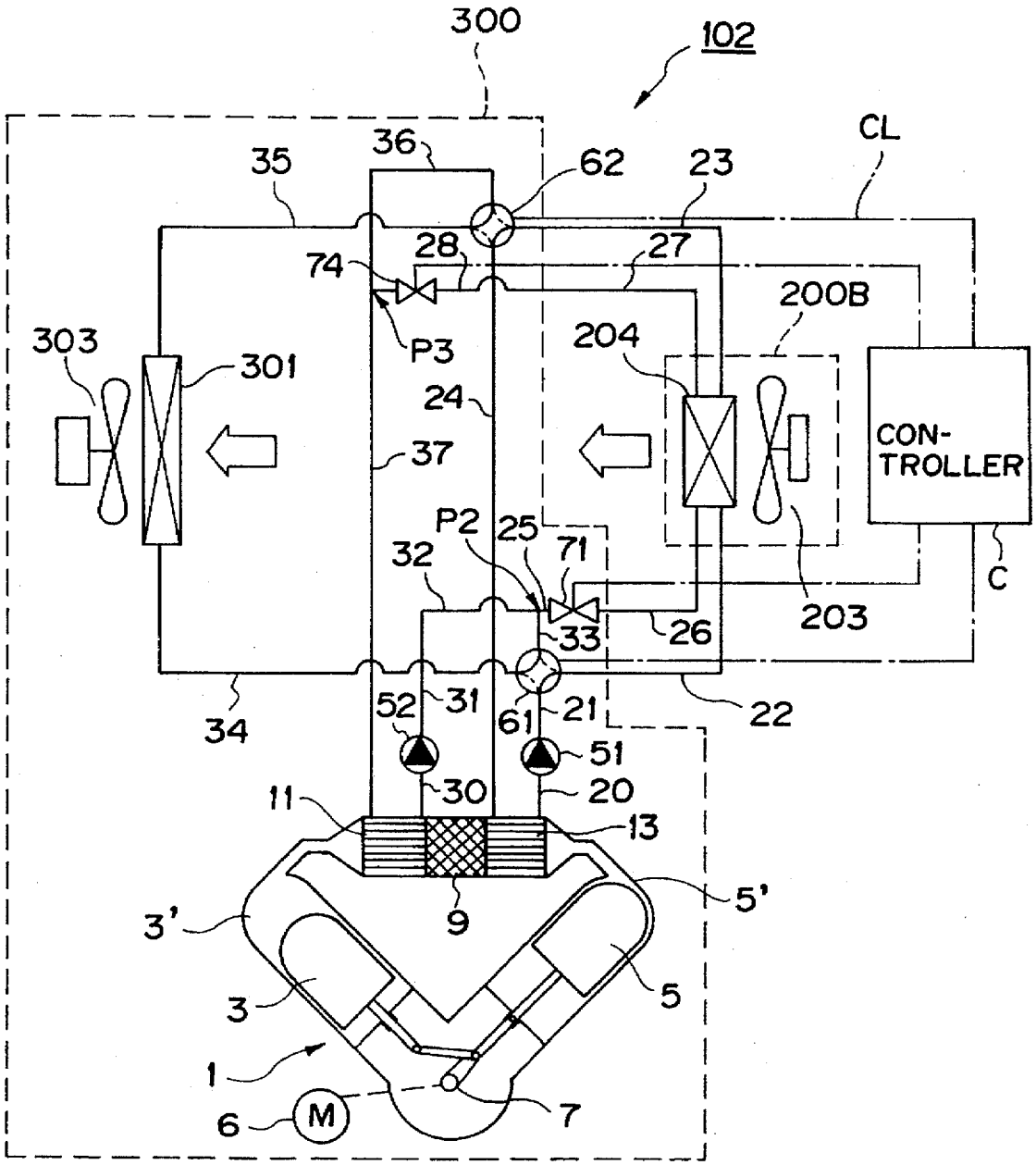
FIG. 4 is a circuit diagram showing a modification of the second embodiment.

FIG. 4 shows a modification of the second embodiment of FIG. 3.

The modification of FIG. 4 has substantially the same construction as the second embodiment except that the first and second indoor heat exchangers 201 and 202 are integrally formed as a single indoor heat exchanger 204 connected to two pipe systems. The same elements as the second embodiment are represented by the same reference numerals, and the description thereof is omitted.

Like the embodiments shown in FIGS. 1 and 2, in the above embodiments shown in FIGS. 3 and 4, each of the open/close valves 71 and 74 is designed to be adjustable in its opening degree, and the flow amount of fluid (water) passing through each valve can be adjusted by controlling the opening degree of the valve. Each of the four-way valves 61 and 62 and the open/close valves 71 and 74 is equipped with an actuator (not shown) for driving each valve, and these actuators are connected Go the controller C such as a microcomputer or the like, and controlled in accordance with each driving mode by the controller C through the control lines CL (as indicated by one-dotted chain lines).

Further, like the embodiments shown in FIGS. 1 and 2, a route which connects the low-temperature heat exchanger (cooler) 13 or the intermediate-temperature heat exchanger (radiator) 11 and the first indoor heat exchanger 201 or the outdoor heat exchanger 301 in the normal cooling/heating operation corresponds to the first fluid passage, and a route which connects the intermediate-temperature heat exchanger (radiator) 11 and the second indoor heat exchanger 202 in the slightly-heating or slightly-cooling dry operation corresponds to the second fluid passage. As shown in FIGS. 3 and 4, the first fluid passage and the second fluid passage may be juxtaposed with each other. In this case, the pipe arrangement of the first and second fluid passages, etc. can be facilitated. Further, if the-first indoor heat exchange and the second indoor heat exchange are juxtaposed with each other, the effect of the second indoor heat exchanger can be more enhanced.

Figure 5:
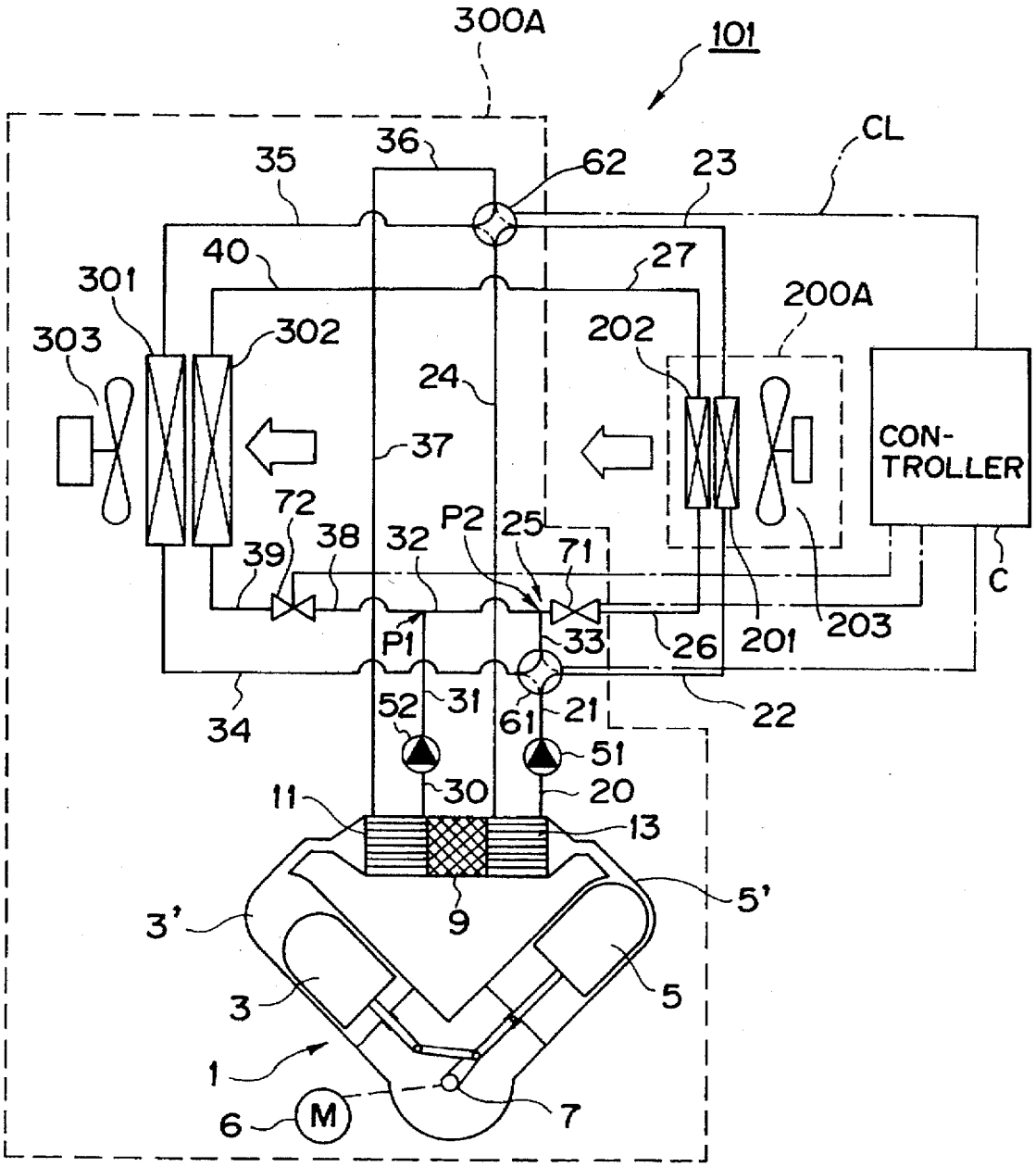
FIG. 5 is a circuit diagram showing a third embodiment of the heat pump type air conditioner according to the present invention.

FIG. 5 shows a cold/hot fluid supply circuit according to a third embodiment of the heat pump type air conditioner of the present invention.

This embodiment has substantially the same construction as the first and second embodiments shown in FIGS. 1 and 3, except that the air conditioner is provided with two outdoor heat exchangers (first and second outdoor heat exchangers) and two indoor heat exchangers (first and second indoor heat exchangers), and the connection of the second fluid passage is controlled so that the hot water heated by the radiator 11 partially and selectively flows into any one of the second outdoor heat exchanger and the second indoor heat exchanger. The same elements as the first embodiment are represented by the same reference numerals, and the detailed description thereof is omitted.

The air conditioner 101 of this embodiment has an indoor unit 200A and an outdoor unit 300A, and the heat gas engine 1 is contained in the outdoor unit 300A.

In this embodiment, the first indoor heat exchanger 201 and the second indoor heat exchanger 202 which are sectioned so as to be connected to two pipe systems are juxtaposed with each other in the indoor unit 200A, and the first outdoor heat exchanger 301 and the second outdoor heat exchanger 302 which are also sectioned so as to be connected to the two pipe systems are also juxtaposed with each other in the outdoor unit 300A.

The low-temperature heat exchanger (cooler) 13 and the first indoor heat exchanger 201 are connected to each other through the water pipe 20, the cold water circulating pump 51, the water pipe 21, the four-way valve 61 and the water pipe 22 in this order, and further the first indoor heat exchanger 201 and the low-temperature heat exchanger (cooler) 13 are connected to each other through the water pipe 23, the four-way valve 62 and the water pipe 24 in this order.

The intermediate-temperature heat exchanger (radiator) 11 and the first outdoor heat exchanger 301 are connected to each other through the water pipe 30, the hot water circulating pump 2, the water pipes 31, 32 and 33, the four-way valve 61 and the water pipe 34 in this order, and further the first outdoor heat exchanger 301 and the intermediate-temperature heat exchanger (radiator) 11 are connected to each other through the water pipe 35, the four-way valve 62, the water pipe 36 and the water pipe 37 in this order. The water pipe 31 is bifurcated into the water pipe 32 and the water pipe 38 at the position P1, and the water pipe 32 is also bifurcated into the water pipe 33 and the water pipe 25 at the position P2.

The water pipe 25 is connected to the first open/close valve 71, and the first open/close valve 71 is also connected to a water pipe 26. The water pipe 26 is also connected to the second indoor heat exchanger 202, and the second indoor heat exchanger 202 is also connected to a water pipe 27. Further, the water pipe 32 is connected to the water pipe 38, and the water pipe 38 is also connected to the second open/close valve 72. The second open/close valve 72 is connected to a water pipe 39, and the water pipe 39 is connected to the second outdoor heat exchanger 302. The second outdoor heat exchanger 302 is connected to a water pipe 40, and the water pipe 40 is connected to the water pipe 37. Next, a normal room-cooling/room-heating operation of this embodiment will be described with reference to FIG. 5.

In a normal cooling operation, the four-way valves 61 and 62 are switched as indicated by solid lines of FIG. 5, and the first open/close valve 71 and the second open/close valve 72 are closed by the controller C. In this case, the cold water which is cooled by the low-temperature heat exchanger (cooler) 13 flows through the water pipe 20, the cold water circulating pump 51, the water pipe 21, the four-way valve 61 and the water pipe 22 into the first indoor heat exchanger 201, and then heat-exchanged with the room air. The cooled air is blown out into the room while the indoor fan 203 is rotated. After the heat exchange, the water in the first indoor heat exchanger 201 flows through the water pipe 23, the four-way valve 62 and the water pipe 24 and returns to the low-temperature heat exchanger (cooler) 13.

At this time, the hot water which is heated by the intermediate-temperature heat exchanger (radiator) 11 flows through the water pipe 30, the hot water circulating pump 52, the water pipes 31, 32 and 33, the four-way valve 61 and the water pipe into the first outdoor heat exchanger 301, and heat-exchanged with the outside air while the outdoor fan 303 is rotated. After the heat exchange, the water in the first outdoor heat exchanger 301 flows through the water pipe 35, the four-way valve 62, the water pipe 36 and the water pipe 37 and returns to the intermediate-temperature heat exchanger (radiator) 11.

Next, in a normal heating operation, the four-way valves 61 and 62 are switched as indicated by dotted lines of FIG. 5, and the first and second open/close valves 71 and 72 are closed by the controller. At this time, the intermediate-temperature heat exchanger (radiator) 11 flows through the water pipe 30, the hot water circulating pump 52, the water pipes 31, 32 and 33, the four-way valve 61 and the water pipe 22 into the first indoor heat exchanger 201, and heat-exchanged with the room air while the indoor fan is rotated 203 to blow out the heated air into the room. After the heat exchange, the water in the first indoor heat exchanger 201 flows through the water pipe 23, the four-way valve 62, the water pipe 36 and the water pipe 37 and returns to the intermediate-temperature heat exchanger (radiator) 11.

At this time, the cold water which is cooled by the low-temperature heat exchanger (cooler) 13 flows through the water pipe 20, the cold water circulating pump 51, the water pipe 21, the four-way valve 61 and the water pipe 34 into the first outdoor heat exchanger 301, and then heat-exchanged with the outside air while the indoor fan 303 is rotated. After the heat exchange, the water in the first outdoor heat exchanger 301 flows through the water pipe 35, the four-way valve 62 and the water pipe 24 and returns to the low-temperature heat exchanger (cooler) 13.

Further, according to the present invention, each of the indoor heat exchanger and the outdoor heat exchanger is sectioned into two heat-exchange systems. That is, the indoor heat exchanger includes the first indoor heat exchanger system and the second indoor heat exchanger system, and the outdoor heat exchanger includes the first outdoor heat exchanger system and the second heat exchanger system. Accordingly, this embodiment has both the effects of the first and second embodiments. That is, the slightly-heating or slightly-cooling dry operation, and the heating and defrosting operation as described above can be freely and selectively performed by only the switching operation of the open/close valves and the four-way valves. Further, if a part of the hot water from the radiator is supplied through the second fluid passage to the second outdoor heat exchanger and the second indoor heat exchanger in the cooling operation, not only the slightly-heating or slightly-cooling dry operation can be performed, but also the heat transfer area of the heat exchanger can be increased to enhance the radiation efficiency.

As described above, the slightly-heating or slightly-cooling dry operation is suitable for such a middle season that an user does not feels too hot, but feels uncomfortably humid and needs to dry the room air (for example, like a rainy or wet season). In this case, the four-way valves 61 and 62 are switched as indicated by solid lines of FIG. 5, and the first open/close valve 71 is fully opened while the second open/close valve 72 is closed.

With the above operation, the water circulating cycle of the normal cooling operation as described above is carried out, and at the same time, the hot water which is heated by the intermediate-temperature heat exchanger (radiator) 11 flows through the water pipe 30, the hot water circulating pump 52 and the water pipes 31 and 32, and then is branched into the water pipe 25 and the water pipe 33 at the branch position P2. A part of the branched hot water flows through the fully-opened first open/close valve 71 and the water pipe 26 into the second indoor heat exchanger 202, and then heat-exchanged with the air which has been cooled and supplied by the first indoor heat exchanger 201 while the indoor fan 203 is rotated. Accordingly, the air cooled by the first indoor heat exchanger 201 is slightly heated with keeping its low humidity. After the heat exchange, the water in the second indoor heat exchanger 202 flows through the water pipe 27 and the water pipe 37 and returns into the intermediate-temperature heat exchanger (radiator) 11. At this time, the water from the second indoor heat exchanger 202 does not flow through the water pipe 40, the second outdoor heat exchanger 302, the water pipe 39, the open/close valve 72 and the water pipe 38 because the open/close valve 72 is closed. Accordingly, through the above cycle, the air which is cooled and dried by the first indoor heat exchanger 201 is slightly heated by the second indoor heat exchanger 202, and blown out into the room, whereby the slightly-heating dry operation can be performed.

If the first open/close valve 71 is not fully opened, but slightly closed, the slightly-heating dry operation can be shifted to the slightly-cooling dry operation. At any rate, a comfortable dry operation can be obtained by suitably adjusting the opening degree of the first open/close valve 71.

As described above, the heating and defrosting operation is performed when it is required to defrost the first outdoor heat exchanger 301 which has been frosted due to the flow of the cold water in the first outdoor heat exchanger 301 during the heating operation. In this case, the four-way valves 61 and 62 are switched as indicated by dotted lines of FIG. 5, and the first open/close valve 71 is closed while the second open/close valve 72 is fully opened. With this operation, the water circulating cycle of the normal heating operation as described above, and at the same time the hot water which is heated by the intermediate-temperature heat exchanger (radiator) 11 flows through the water pipe 30, the hot water circulating pump 52 and the water pipe 31, and then is branched into the water pipe 38 and the water pipe 32 at the branch position P1. A part of the branched hot water flows through the fully-opened second open/close valve 72 and the water pipe 39 into the second outdoor heat exchanger 302, and then heat-exchanged with air while the outdoor fan 303 is rotated. Therefore, the air to be supplied to the first outdoor heat exchanger 301 is heated by the hot water of the second outdoor heat exchanger 302. After the heat exchange, the water in the second outdoor heat exchange 302 flows through the water pipe 40 and the water pipe 37 and returns into the intermediate-temperature heat exchanger (radiator) 11.

With the above cycle, the hot water flows into the second outdoor heat exchanger 302, and the air to be supplied to the first outdoor heat exchanger 301 is heated by the second outdoor heat exchanger 302. Therefore, even when the first outdoor heat exchanger 301 is frosted, the first outdoor heated exchanger can be defrosted by the heated air without temporarily ceasing the heating operation (i.e., while the heating operation is continued).

The second open/close valve 72 may not be fully opened, but partially opened (i.e., it may have a suitably opening degree). By the adjustment of the opening degree, the amount of the hot water flowing into the second outdoor heat exchanger 302 can be varied, whereby the defrosting power can be suppressed to the indispensable and minimum value. The use of the hot water for defrosting causes reduction in efficiency of the air conditioner, and thus the defrosting efficiency is preferably minimized.

Figure 6:
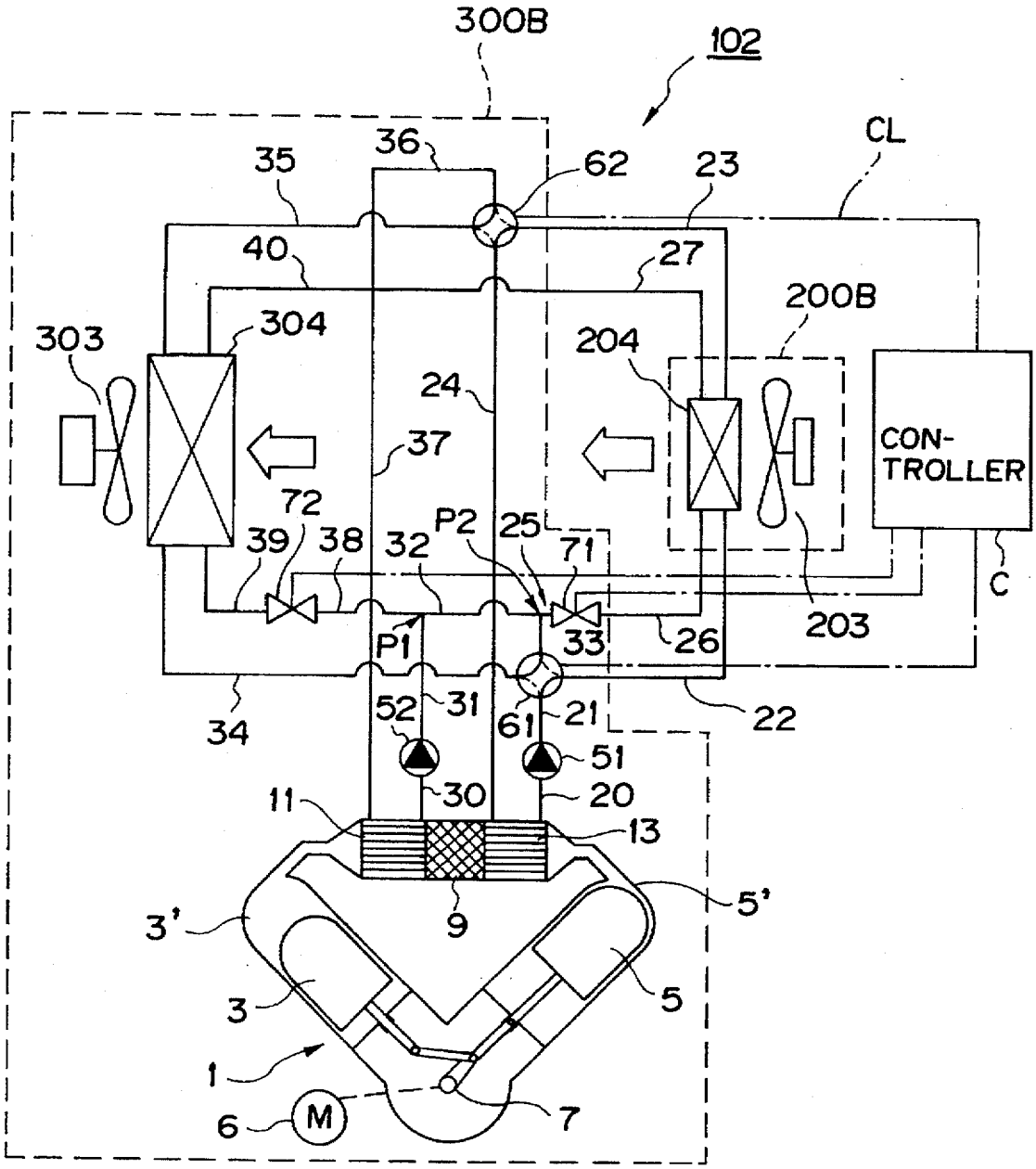
FIG. 6 is a circuit diagram showing a modification of the third embodiment of FIG. 5.

FIG. 6 shows a modification of the third embodiment of FIG. 5. The air conditioner 102 of FIG. 6 has substantially the same construction as the air conditioner 102 of the third embodiment except that the first and second indoor heat exchangers 201 and 202 are integrally formed as a single indoor heat exchanger 204 connected to two pipe systems, and/or the first and second outdoor heat exchangers 301 and 302 are integrally formed as a single outdoor heat exchanger 304 connected to two pipe systems. The same elements as the third embodiment are represented by the same reference numerals, and the description thereof is omitted.

Like the embodiments shown in FIGS. 1 to 4, in the above embodiments shown in FIGS. 5 and 6, each of the open/close valves 71 and 72 is designed to be adjustable in its opening degree, and the flow amount of fluid (water) passing through each valve can be adjusted by controlling the opening degree of the valve. Each of the four-way valves 61 and 62 and the open/close valves 71 and 72 is equipped with an actuator (not shown) for driving each valve, and these actuators are connected to the controller C such as a micro-computer or the like, and controlled in accordance with each driving mode by the controller C through the control lines CL (as indicated by one-dotted chain lines).

Further, like the embodiments shown in FIGS. 1 to 4, a route which connects the low-temperature heat exchanger (cooler) 13 or the intermediate-temperature heat exchanger (radiator) 11 and the first indoor heat exchanger 201 or the outdoor heat exchanger 301 in the normal cooling/heating operation corresponds to the first fluid passage, and a route which connects the intermediate-temperature heat exchanger (radiator) 11 and the second indoor heat exchanger 202 in the slightly-heating or slightly-cooling dry operation corresponds to the second fluid passage. Further, a route which connects the intermediate-temperature heat exchanger (radiator) 11 and the second outdoor heat exchanger 302 in the heating and defrosting operation corresponds to a third fluid passage. As shown in FIGS. 5 and 6, the second fluid passage and the third fluid passage may be juxtaposed with the first fluid passage. In this case, the pipe arrangement of the first, second and third fluid passages, etc. can be facilitated. Further, if the first indoor heat exchange and the second indoor heat exchanger are juxtaposed with each other and/or the first outdoor heat exchange and the second indoor heat exchanger are juxtaposed with each other, the effects of the second indoor heat exchanger and the second outdoor heat exchanger can be more enhanced.

The present invention is not limited to the above embodiments, For example, in the above embodiments, the Stirling cycle is used for the heat gas engine 1, however, a heat gas engine using a heat-absorption cycle may be used. Further, in the above embodiments, not only the open/close valves, but also the four-way valves are used to perform the selection control of the passages, however, the selection control may be performed by combining only open/close valves or three-way valves.

In the above embodiments, the open/close valves and the four-way valves are controlled by the same controller C. However, each of these valves may be controlled independently by an individual controller. Further, in the above embodiments, only one heat exchanger to which a part of the hot water is supplied is newly provided to the indoor unit and/or the outdoor unit in addition to the original indoor heat exchanger and/or the original outdoor heat exchanger. However, the number of the heat exchangers is not limited to one, and it may be set to any number.

As described above, according to the heat pump type air conditioner of the present invention, in the normal room-cooling/room-heating operation, the hot fluid from the radiator flows through the first fluid passage into the outdoor heat exchanger (or the indoor heat exchanger) while the cold fluid from the cooler flows through the first fluid passage into the indoor heat exchanger (outdoor heat exchanger), whereby the room-cooling/room-heating operation is performed. When the outdoor heat exchanger is required to be defrosted in the above state, a part of the hot fluid from the radiator is allowed to flow through the second fluid passage into the second outdoor heat exchanger by fluid branch means comprising the valves. Therefore, even when the first outdoor heat exchanger is frosted in the room-heating operation, the frosted first outdoor heat exchanger can be easily defrosted by the heat of the second outdoor heat exchanger.

Further, if a part of the hot fluid is allowed to flow through the second fluid passage into the second outdoor heat exchanger in the room-cooling operation, the second outdoor heat exchanger as well as the first outdoor heat exchanger can be also used for heat radiation. Therefore, the heat transfer area for radiation can be increased, and the radiation characteristic can be improved.

When the dry operation is carried out, a part of the hot fluid from the radiator is allowed to flow through the second fluid passage into the second indoor heat exchanger by the fluid branch means. Therefore, the air which has been cooled and dried by the first indoor heat exchanger is heated by the second indoor heat exchanger, whereby the slightly-heating or slightly-cooled dry operation can be easily performed.

Further, according to the heat pump type air conditioner, if the second outdoor heat exchanger is disposed at the upstream side of the first outdoor heat exchanger, the defrosting operation can be performed with high efficiency. If the second indoor heat exchanger is disposed at the downstream side of the first indoor heat exchanger, the dry operation can be performed with high efficiency.

Still further, according to the heat pump type air conditioner, an open/close valve whose opening degree can be adjusted is used to selectively make a part of the hot fluid from the radiator flow into the second fluid passage. Therefore, the (slightly-heating or slightly-cooling)' dry operation and the defrosting operation can be easily performed while suitably varying the power thereof.

Still further, according to the heat pump type air conditioner, the pipe arrangement is performed so that the first fluid passage and the second fluid passage are Juxtaposed with each other (or the second and third fluid passages are juxtaposed with the first fluid passage), the pipe arrangement, etc. in the air conditioner can be facilitated.

What is claimed is:

1. A heat pump type air conditioner including:

a heat gas engine having a cooler and a radiator;

a first outdoor heat exchanger provided in an outdoor unit;

a first indoor heat exchanger provided in an indoor unit;

at least one additional heat exchanger provided in at least one of said outdoor unit and said indoor unit;

a first fluid passage through which fluid cooled through heat-exchange operation of said cooler is guided to a selected one of said first indoor heat exchanger and said first outdoor heat exchanger, and fluid heated through heat-exchange operation of said radiator is guided to the other of said first indoor heat exchanger and said first outdoor heat exchanger in room-cooling or room-heating operation;

a second fluid passage through which a part of the fluid heated by said radiator is guided to the at least one heat exchanger; and fluid branching means for selectively allowing the part of the fluid heated by said radiator to flow into said second fluid passage.

2. The heat pump type air conditioner as claimed in claim 1, wherein said fluid branching means comprises flow amount adjusting means for adjusting the flow amount of the branched part of the heated fluid into said second fluid passage.

3. The heat pump type air conditioner as claimed in claim 1, wherein said flow amount adjusting means comprises opening/closing valves which are adjustable in opening degree to adjust the flow amount of the branched part of the heated fluid.

4. The heat pump type air conditioner as claimed in claim 1, wherein said heat gas engine comprises an external combustion engine using a Stirling cycle.

5. The heat pump type air conditioner as claimed in claim 1, the fluid comprises water.

6. The heat pump type air conditioner as claimed in claim 1, wherein said heat exchanger comprises a second outdoor heat exchanger which is provided in said outdoor unit and into which the branched heated fluid flows from said second fluid passage, and wherein said heat pump type air conditioner is further provided with control means for controlling said first fluid passage so that the heated fluid from said radiator flows into said first indoor heat exchanger and the cold water from said cooler flows into said first outdoor heat exchanger in the room-heating operation, and controlling said fluid branching means so that the branched part of the heated fluid from said radiator flows into said second outdoor heat exchanger when said first outdoor heat exchanger is defrosted.

7. The heat pump type air conditioner as claimed in claim 6, wherein said fluid passage and said second fluid passage are juxtaposed with each other.

8. The heat pump type air conditioner as claimed in claim 6, wherein said first outdoor heat exchanger and said second outdoor heat exchanger are formed separately with each other or integrally with each other.

9. The heat pump type air conditioner as claimed in claim 6, wherein said second outdoor heat exchanger is disposed at an upstream side of said first outdoor heat exchanger, whereby said first outdoor heat exchanger is defrosted by the heat of the heated fluid in said second outdoor heat exchanger.

10. The heat pump type air conditioner as claimed in claim 1, wherein said heat exchanger comprises a second indoor heat exchanger which is provided in said indoor unit and into which the branched heated fluid flows from said second fluid passage, and wherein said heat pump type air conditioner are further provided with control means for controlling said first fluid passage so that the cooled fluid from said cooler flows into said first indoor heat exchanger and controlling said fluid branching means so that the branched part of the heated fluid from said radiator flows into said second indoor heat exchanger when dry operation is carried out.

11. The heat pump type air conditioner as claimed in claim 10, wherein said first fluid passage and said second fluid passage are juxtaposed with each other.

12. The heat pump type air conditioner as claimed in claim 10, wherein said first indoor heat exchanger and said second indoor heat exchanger are formed separately with each other or integrally with each other.

13. The heat pump type air conditioner as claimed in claim 10, wherein said second indoor heat exchanger is disposed at a downstream side of said first indoor heat exchanger, whereby air which is cooled by said first indoor heat exchanger is heated by the heat of the heated fluid in said second indoor heat exchanger to perform slightly-heating or slightly-cooling dry operation.

14. The heat pump type air conditioner as claimed in claim 1, wherein said heat exchanger comprises a second outdoor heat exchanger and a second indoor heat exchanger which are provided in said outdoor unit and said indoor unit respectively and into which the branched heated fluid flows from said second fluid passage, and wherein said heat pump type air conditioner are further provided with control means for controlling said first fluid passage so that the heated fluid from said radiator flows into said first indoor heat exchanger and the cold water from said cooler flows into said first outdoor heat exchanger in the room-heating operation, and controlling said fluid branching means so that the branched part of the heated fluid from said radiator flows into said second outdoor heat exchanger when said first outdoor heat exchanger is defrosted in the room-heating operation, and for controlling said first fluid passage so that the cooled fluid from said cooler flows into said first indoor heat exchanger and controlling said fluid branching means so that the branched part of the heated fluid from said radiator flows into said second indoor heat exchanger when dry operation is performed.

15. The heat pump type air conditioner as claimed in claim 14, wherein said fluid branching means comprises flow amount adjusting means for adjusting the flow amount of the branched part of the heated fluid into said second fluid passage.

16. The heat pump type air conditioner as claimed in claim 14, wherein said flow amount adjusting means comprises a first open/close valve which is disposed between said first and second fluid passages and is adjustable in opening degree so that the part of the heated fluid from said radiator flows into said second indoor heat exchanger when dry operation is performed, and a second open/close valve which is disposed between said first and second fluid passages and is adjustable in opening degree so that the part of the heated fluid from said radiator flows into the second outdoor heat exchanger when a defrosting operation is performed in room-heating operation.

17. The heat pump type air conditioner as claimed in claim 14, wherein said first indoor heat exchanger and said second indoor heat exchanger are formed separately from each other or integrally with each other, and/or said first outdoor heat exchanger and said second outdoor heat exchanger are formed separately from each other or integrally with each other.

18. The heat pump type air conditioner as claimed in claim 14, wherein said first fluid passage and said second fluid passage are juxtaposed with each other.

19. The heat pump type air conditioner as claimed in claim 1, wherein:

during room-cooling operation, fluid cooled through heat-exchange operation of said cooler is guided, through said first passage, to said first indoor heat exchanger and fluid heated through heat-exchange operation of said radiator is guided, through said first passage, to said first outdoor heat exchanger; and during room-heating operation, fluid heated through heat-exchange operation of said radiator is guided, through said first passage, to said first indoor heat exchanger and fluid coiled through heat-exchange operation of said cooler is guided, through said first passage, to said first outdoor heat exchanger;

whereby the same first fluid passage is used to supply the same first indoor heat exchanger with either cooled fluid or heated fluid, depending on the selected operation.

20. The heat pump type air conditioner as claimed in claim 1, further comprising a first valve positioned in said first fluid passage between said heat gas engine and said first indoor heat exchanger, wherein said first valve has a first position coupling said indoor heat exchanger with said cooler to perform said room-cooling operation and a second position coupling said indoor heat exchanger with said radiator to perform said room-heating operation.

* * * * *

UNITED STATES PATENT AND TRADEMARK OFFICE

CERTIFICATE OF CORRECTION

PATENT NO. : 5,664,421

DATED : September 9, 1997

INVENTOR(S) : Junji MATSUE et al.

It is certified that error appears in the above-identified patent and that said Letters Patent is hereby corrected as shown below:

On the title page, Item [75], Inventors, change "Kasagake-machi" to --Nitta --; change "Oura-machi" to --Oura --; and change "Oizumi-machi" to --Oura --.

Signed and Sealed this

Twenty-seventh Day of January, 1998

Bruce Lehman

*Attest:*

BRUCE LEHMAN

*Attesting Officer*

*Commissioner of Patents and Trademarks*